US007475838B2

(12) United States Patent
Mori et al.

(10) Patent No.: US 7,475,838 B2
(45) Date of Patent: Jan. 13, 2009

(54) SHREDDER

(75) Inventors: Makoto Mori, Chiba (JP); Akira Konno, Saitama (JP); Yasuo Tan, Kanagawa (JP)

(73) Assignee: Carl Manufacturing Co., Ltd. (JP)

( * ) Notice: Subject to any disclaimer, the term of this patent is extended or adjusted under 35 U.S.C. 154(b) by 373 days.

(21) Appl. No.: 11/478,058

(22) Filed: Jun. 29, 2006

(65) Prior Publication Data

US 2007/0063081 A1 Mar. 22, 2007

(30) Foreign Application Priority Data

Jul. 1, 2005 (JP) ..... 2005-193712

(51) Int. Cl.

| | |
|---|---|
| ***B02C 4/32*** | (2006.01) |
| ***B02C 7/14*** | (2006.01) |
| ***B02C 9/04*** | (2006.01) |
| ***B02C 11/08*** | (2006.01) |
| ***B02C 23/00*** | (2006.01) |

(52) U.S. Cl. ..... 241/36; 241/236

(58) Field of Classification Search ..... 241/36, 241/236

See application file for complete search history.

(56) References Cited

U.S. PATENT DOCUMENTS 2,899,140 A * 8/1959 Hellyer ..... 241/190
4,564,146 A * 1/1986 Bleasdale ..... 241/236

* cited by examiner

*Primary Examiner*—Bena Miller
(74) *Attorney, Agent, or Firm*—Wood, Phillips, Katz, Clark & Mortimer

(57) ABSTRACT

There is a shredder comprising: a chopped apparatus including an insertion opening for inserting wastes, and an exhaust port for discharging chopped wastes; a waste container which is displaceable between a receivable position where to receive the chopped wastes and a non-receivable position where not to receive the chopped wastes; a claw portion provided with the waste container; a shutter, which opens the exhaust port by moving the waste container to the receivable position, and which closes the exhaust port by moving the waste container to the non-receivable position; a lock member, which is displaceable between a locked position where to close the shutter and an unlocked position where to make the shutter movable; and an operation lever which displaces the lock member to the unlocked position with the claw portion.

6 Claims, 4 Drawing Sheets

SHREDDER

BACKGROUND OF THE INVENTION

1. Field of the Invention

The present invention relates to a shredder for cutting disused papers, and more particularly to a shredder provided with a shutter, which opens/closes an exhaust port for discharging chopped wastes by interlocking with displacing operation of a waste container.

2. Description of the Related Art

Japanese Utility Model Application Laid-Open No. Sho 64-48146 discloses a conventional shredder. See FIGS. 7 and 8. The conventional shredder includes: a housing 52 comprising an insertion opening 53 where wastes are inserted and an exhaust port 54 where chopped wastes 64 are discharged; a chopping portion 50 comprising a chopping mechanism 56 provided with a pair of rotary cutters 65 and a motor 57 driving the rotary cutters 55; a waste container 51 receiving the chopped wastes 64 discharged from the exhaust port 54 wherein the waste container 51 is displaceable between a position that the wastes 64 are receivable (receivable position) and a poison that the wastes 64 are not receivable (non-receivable position); and a shutter 58 slidably provided along a guide rail 59 formed at the bottom portion of the housing 52. The shutter 58 opens the exhaust port 54 in the receivable position and closes the exhaust port 54 in the non-receivable position.

As shown in FIG. 7, when this shredder is in the receivable position, a side-wall 62*a* of a cover body 62 where placed at an upper portion of the waste container 51 works against elastic force made by a compression spring 60, whereby the shutter 58 stays in the receivable position. On the other hand, as shown in FIG. 8, when this shredder is in the non-receivable position, the shutter 58 is displaced by the elastic force of the compression spring 60 in the direction that the shutter 58 closes the exhaust port 54.

The shredder hereinabove described is made to open and close the exhaust port of the chopping portion by interlocking with displacing operation of the waste container. Because the exhaust port can be closed with the shutter by displacing the waste container in the non-receivable position, the chopped wastes remaining in the chopping portion can be prevented from falling to the waste container. However, the shutter is simply pressing the compression spring; it is quite easy to manually displace the shutter to open the exhaust port This means that operators may manually press the shutter to take off the wastes hanging down from the rotary cutters and accidentally touch the rotary cutters or high voltage parts.

SUMMARY OF THE INVENTION

The present invention has been made in light of the above circumstances, and it is an object of the present invention to provide a shredder with a shutter, which opens/closes an exhaust port by interlocking with displacing operation of a waste container. Further, the shutter is made not to be manually displaced by operators after a waste container is pulled out, unless the operators use specially-designed tools.

In order to achieve the object described above, according to an aspect of the present invention, there is provided a shredder comprising a chopped apparatus including an insertion opening for inserting wastes, and an exhaust port for discharging chopped wastes; a waste container which is displaceable between a receivable position where to receive the chopped wastes and a non-receivable position where not to receive the chopped wastes; a claw portion provided with the waste container; a shutter, which opens the exhaust port by moving the waste container to the receivable position, and which closes the exhaust port by moving the waste container to the non-receivable position wherein the shutter is energized in a direction to close the exhaust port; a lock member, which is displaceable between a locked position where to close the exhaust port and an unlocked position where to open the exhaust port wherein the lock member is energized in a direction to the locked position; and an operation lever which displaces the lock member to the unlocked position, wherein the operation lever is operated with the claw portion by moving the waste container to the receivable position thereby shifting the lock member from the locked position to the unlocked portion.

With the shredder described above, even though operators try to manually shift the shutter to the unlocked position after the waste container is pulled out from the lower housing, the shutter is certainly locked with the lock member. The operators are thus prohibited from manually shifting the shutter to open the exhaust port, unable to insert their fingers from the exhaust port, resulting in improvement of an operational safety of the shredder.

In the aspect of the present invention, the operation lever is covered with a guide cover preventing operation of the operation lever unless using specially-designed tools approximately identical with a shape and a size of the claw portion. Since operators need to use specially-designed tools approximately identical with the claw portion, an operational safety of the shredder is improved.

In the aspect of the present invention, the guide cover is simply composed of a pair of cover members formed so as to face with and go along the claw portion. No complex manufacturing process would be needed for the guide cover.

In the aspect of the present invention, the pair of the cover members have a front-half portion and a rear-half portion wherein the front-half portion is widen toward the claw portion and has a broader width than the rear-half portion while the rear-half portion has a slightly broader width than the width of the claw portion.

With the above structure, the front-half portion of the pair of the cover members can lead the claw portion of the waste container toward the rear-half portion without having any difficulties when pushing the container inside of the lower housing. Pulling-in and pulling-out operations of the waste container would be thus eased.

In the aspect of the present invention, the lock member, the operation lever and the guide cover are provided with the shutter as one unit, thereby simplifying the structure of the shutter.

DETAILED DESCRIPTION OF THE PREFERRED EMBODIMENTS

Figure 1:
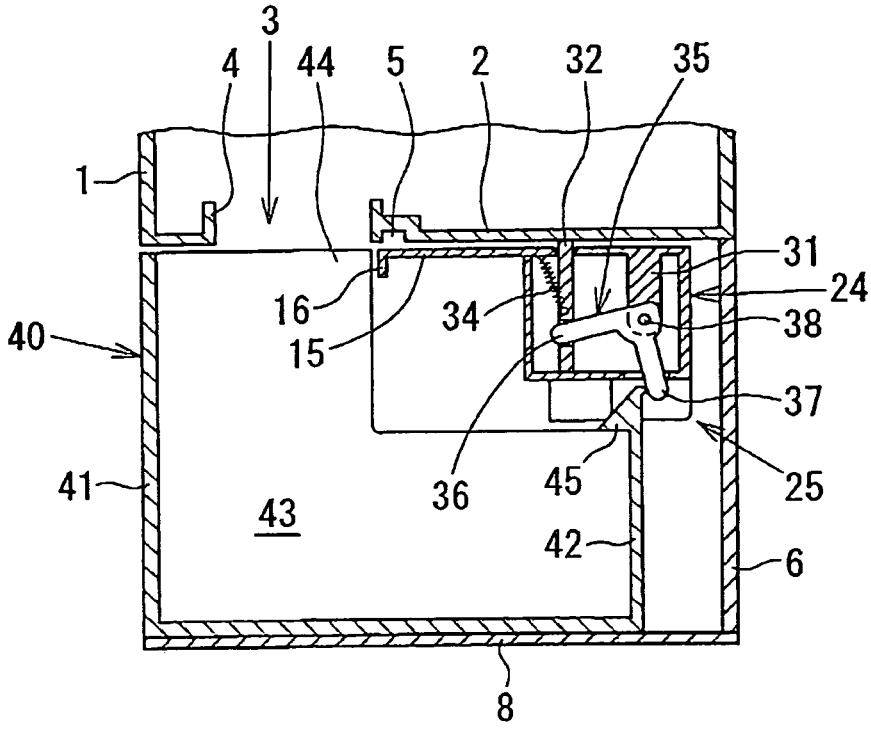
FIG. 1 is a main sectional view of a shredder according to an embodiment of the present invention wherein a waste container is placed inside of a shredder so as to open an exhaust port.
Figure 2:
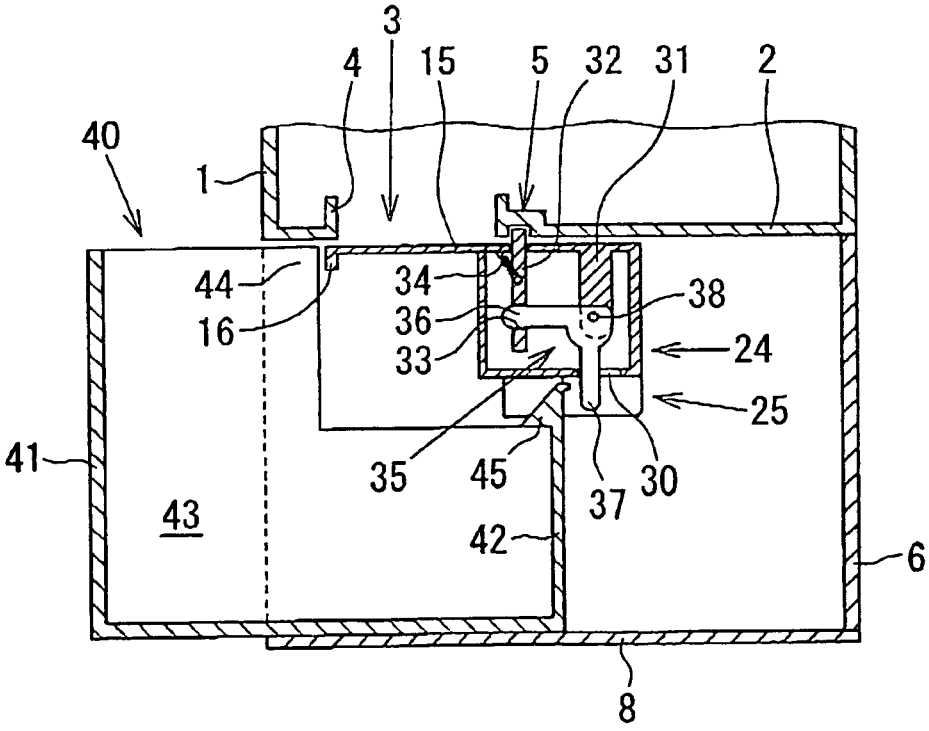
FIG. 2 is a main sectional view of a shredder according to an embodiment of the present invention wherein a waste container is pulled out from a shredder so as to close an exhaust port with a shutter.
Figure 3:
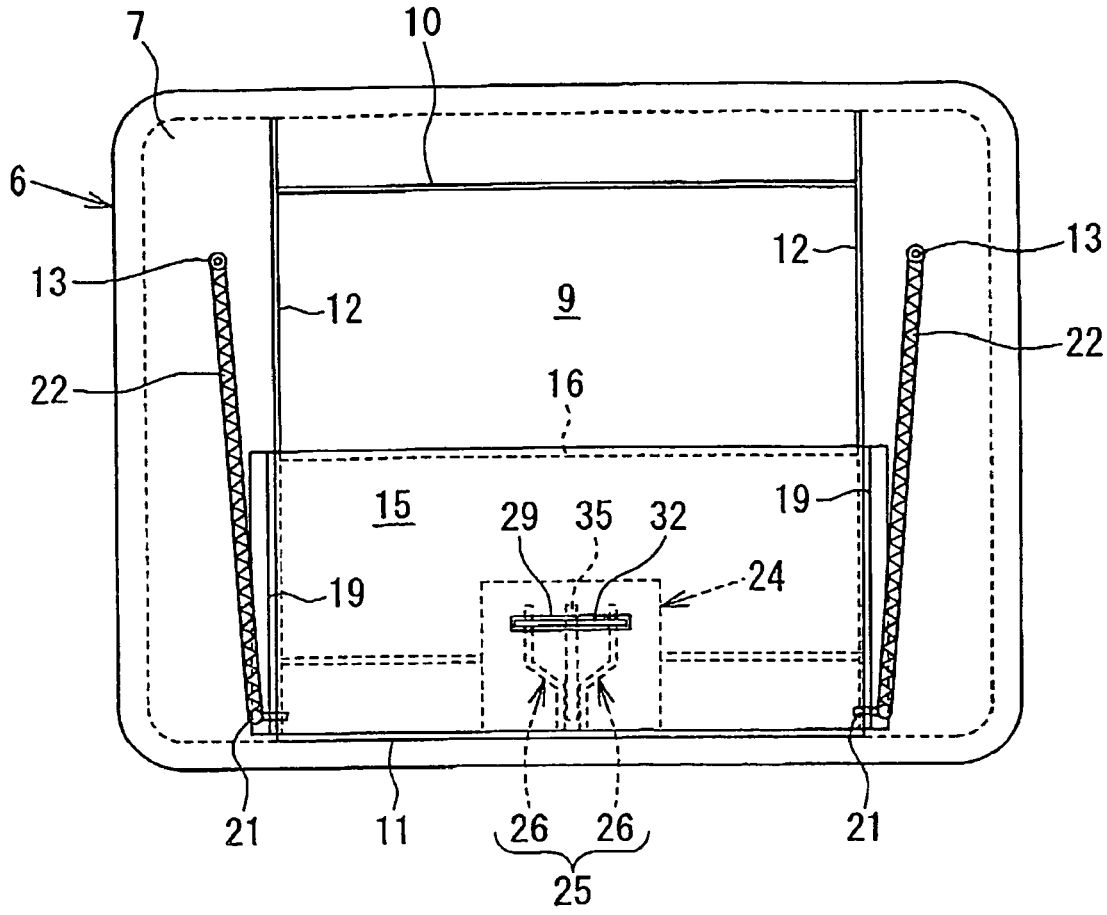
FIG. 3 is a main plane view of a shredder according to an embodiment of the present invention wherein a lower hosing is viewed from a top while an exhaust port is opened.
Figure 4:
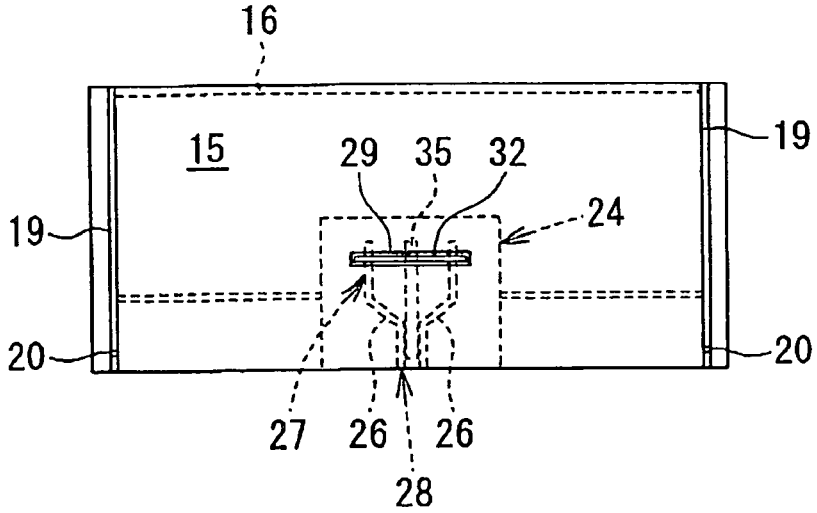
FIG. 4 is a plan view of the shutter explained in FIG. 3.

Preferred embodiments of the present invention will hereinafter be described with reference to the accompanying drawings 1 to 6. As shown in FIGS. 1 and 2, a shredder according to the present invention includes: an upper housing 1 having a chopping portion (not shown in figures) cutting disused papers; a lower housing 6 placed beneath the upper housing 1; a waste container 40 placed in the lower housing 6 and displaceable from the lower housing 6; and a shutter 15 opening/closing an exhaust port 3 of the upper housing 1 by interlocking with displacing operation of the waste container 40.

A bottom wall 2 of the upper housing 1 is made to be placed over the lower housing 6 and has the exhaust port 3 for discharging wastes cut by the chopping portion. Further, the bottom wall 2 has a flange 4 made integrally thereto; the flange 4 is circumferentially made at the opening of the exhaust port 3. Still further, at place adjacent to the flange 4, nearly at the center of the bottom wall 2, a concave engagement 5 where a lock member 32 (described later) is engaged is provided.

The lower housing 6 has an upper wall 7 on which the upper housing 1 is placed and also has a bottom wall 8 supporting the waste container 40 in a displaceable manner. Further, the front surface of the lower hosing 6 is opened so that the waste container 40 can be pulled out. The upper wall 7 of the lower housing 6 has an opening portion 9 in which to communicate with the exhaust port 3 of the upper housing 1 and to arrange the shutter 15. The opening portion 9 is circumferentially provided with a front flange 10, a rear flange 11 and side flanges 12 (used as a guide rail); the shutter 15 is movably placed over and along the side flanges 12.

On the upper wall 7 of the lower housing 6, at both sides of the flanges 12, spring engagements 13 are provided so as to engage one end portions of shutter tensile springs 22 in which to make the shutter 15 energized in the direction that the exhaust port 3 is closed The opening 9 of the lower housing 6 obtains a communication to the exhaust port 3 of the upper housing 1 when the waste container 40 is placed in the lower housing 6.

The waste container 40 has a front wall 41, a rear wall 42, side was 43 and a bottom wall; the surface facing the bottom wall 2 of the upper housing 1 is opened. The front wall 41 of the waste container 40 has an approximately identical shape with a front-open-portion of the lower housing 6. The waste container 40 has a square cutout, forming a step portion between the front wall 41 and the rear wall 42. Through the step portion, the waste container has a side contact portion 44 which is made contact against a front-end flange 16 of the shatter 15 when the waste container 40 is pushed to place inside of the lower housing 6. Further, at the upper portion of the rear wall 42 of the waste container 40 has a claw portion 45 projected upward toward the upper housing 1 so as to push an operation end 37 of an operation lever 35 of the shutter 15. The width of the claw portion 45 is formed slightly smaller than the width of a guide cover 28 of a guide cover 25 (composed of cover members 26, 26), so that the claw portion 45 can move along the guide cover 25 smoothly.

The width of the claw portion 45 or a pair of the cover members 26, 26 is determined in a way that operators cannot place their fingers thereinto. Specifically, unless using specially-designed tools having the width equal to or smaller than the width of the claw portion 45 or a pair of the cover members 26, 26, the operators can not open the shutter 15 through the operation end 37 of the operation lever 35.

The shutter 15 moves along the side flanges 12 formed at both sides of the opening 9 of the lower housing 6, so that it can manage disposal of chopped wastes by opening or closing the exhaust port 3 of the of the upper housing 1. As shown in FIGS. 3 to 6, the shutter 15 is formed in approximately square. At both short sides and undersurface of the square shutter 15, guide flanges 18 are formed so as to engage with the side flanges 12. See FIG. 6. Further, at both short sides and top surface of the square shutter 15, upper flanges 19 are formed. The upper flanges 19 have engagement pin holes 20 where engagement pins 21 are inserted thereinto so as to engage other end portions of the shutter tensile springs 22. See FIG. 4. Still further, as shown in FIGS. 1 and 2, the shutter 15 has the front-end flange 16 projected downward toward the bottom wall 8 of the lower housing 6; the front-end flange 16 abuts to the side contact portion 44 of the side wall 43 of the waste container 40.

Figure 5:
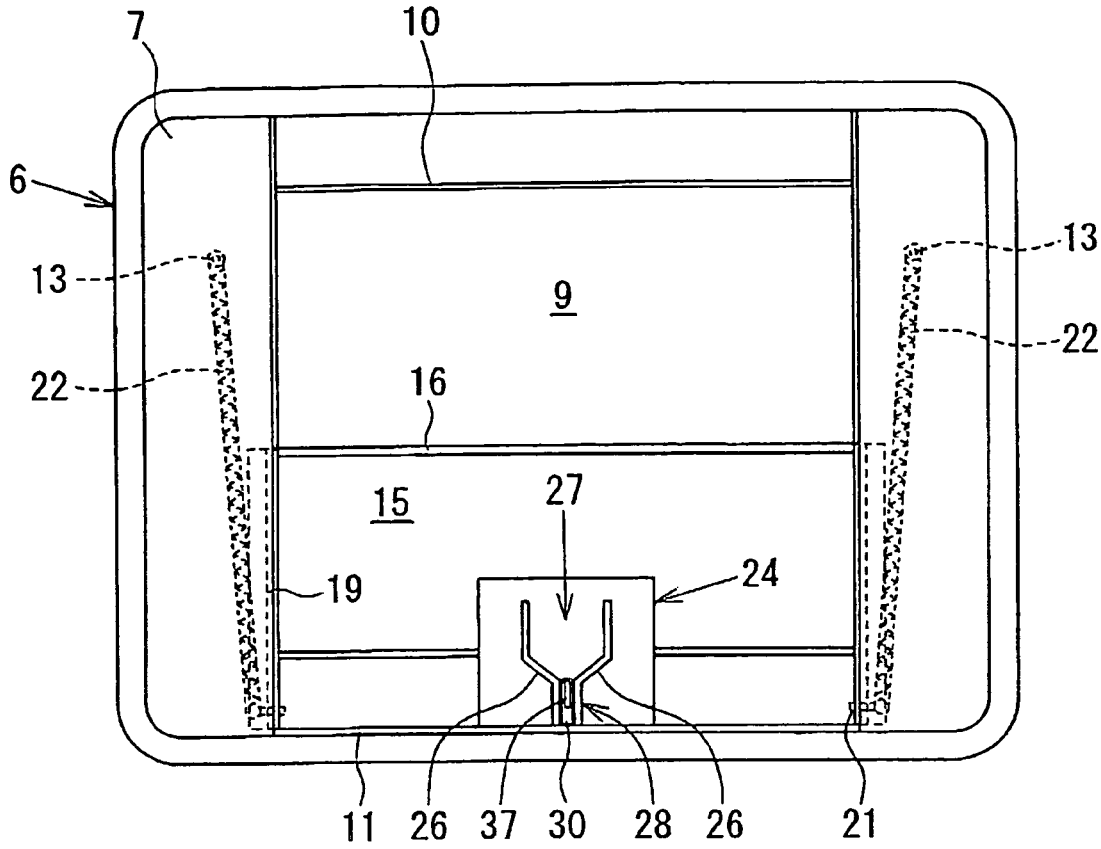
FIG. 5 is a rear view of the shutter explained in FIG. 3.
Figure 6:
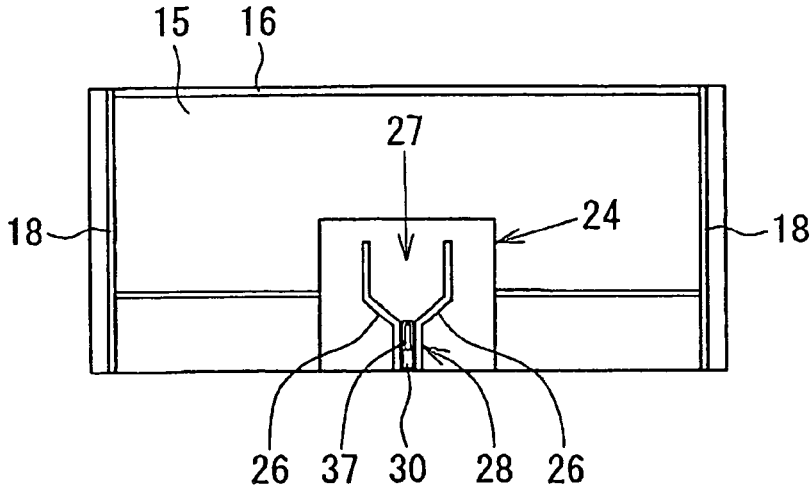
FIG. 6 is a rear view of the shutter explained in FIG. 4.
Figure 7:
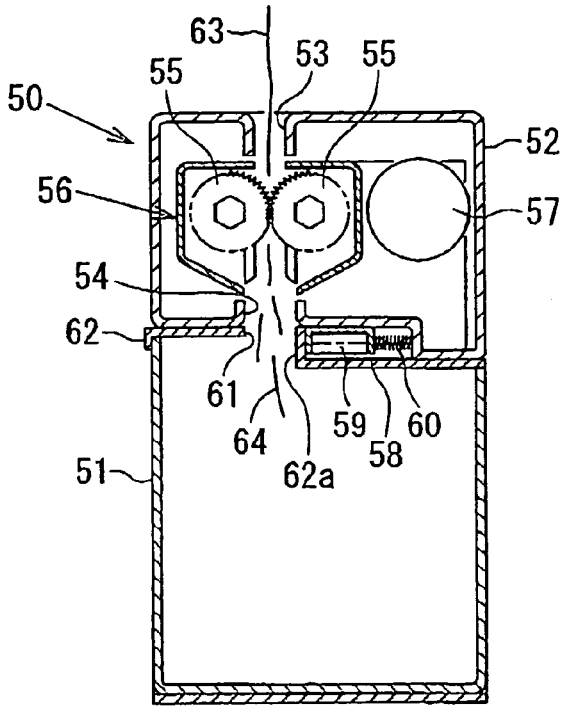
FIG. 7 is a main sectional view of a conventional shredder wherein a waste container is placed in a shredder so as to open an exhaust port.
Figure 8:
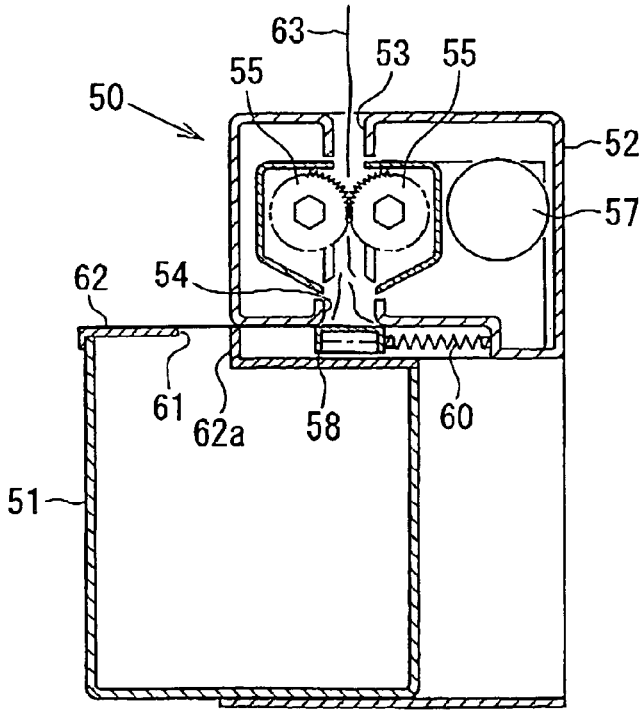
FIG. 8 is a main sectional view of a conventional shredder wherein a waste container is pulled out from a shredder so as to close an exhaust port.

The shutter 15 has a lock mechanism portion 24 approximately box shape and projected downward toward the bottom wall 8 of the lower house 6. As shown in FIGS. 5 and 6, at the bottom surface of the lock mechanism portion 24, the guide cover 25 including a pair of the cover members 26, 26, which is formed as projected downward and along the direction that the waste container 40 is displaced. The guide cover 25 includes a front-half portion 27 which is made broader in its width toward the claw portion 45 of the waste container 40. On the other hand, the guide cover 25 also includes a rear-half portion 28 at the side where the operation end 37 of the operation lever 35 is provided; the rear-half portion 28 is formed so as to have slightly broader width than the width of the claw portion 45. At the bottom surface of the lock mechanism portion 24, an operation end hole 30 is formed so that the operation end 37, one end portion of the operation lever 36, is inserted therethrough so as to project downward Here, as shown in FIGS. 1 and 2, the height of the downward projection of the rear-half portion 28 is set greater than the height of the downward projection of the operation end 37 of the operation lever 35.

The lock mechanism portion 24 has a lock insert hole 29 at its upper front portion At the upper rear portion of the lock mechanism portion 24, an operation lever support 31 is projected downward to the bottom wall 8 of the lower housing 6. At the lower portion of the operation lever support 31, the mid connection of the L-shaped operation lever 35 is connected with an axis point 38 in an oscillational manner. Further, in the lock mechanism portion 24, the lock member 32 is provided as that the top end thereof is projected upward from the lock insert hole 29. The lock member 32 is also energized in an upward direction by means of a lock member spring 34. Still further, at the lower portion of the lock member 32 has an operation through hole 33 as that an operation end 36 of the operation lever 35 is inserted.

The shredder according to the present invention is assembled in the following manner. First, as shown in FIGS. 3 to 6, at the side flanges 12 provided at both sides of the opening portion 9 of the lower housing 6, the guide flanges 18 provided at the lower surface of the both sides of the shutter 15 is engaged. The shutter 15 is provided over the upper wall 7 of the lower housing 6 as that the lock mechanism portion 24 faces downward. See FIGS. 1 and 2. Then, one end portions of the shutter tensile springs 22 are engaged with the spring engagements 13 formed at the upper wall 7 of the lower housing 6. Other end portions of the shutter tensile springs 22 are engaged with the engagement pin holes 20 formed at the upper flanges 19 of the shutter 15 through the engagement pins 21. In the condition, as shown in FIG. 2, the upper portion of the lock member 32 is projected upward from the lock insert hole 29, while the shutter 15 is abutted against the front flange 10 of the opening portion 9 of the lower housing 6 by being energized with the shutter tensile springs 22.

Next, the upper housing 1 is placed over the lower housing 6 in such a manner that the upper end portion of the lock member 32 projected upward from the lock insert hole 29 of the shutter 15 should be engaged with the concave engagement 5 formed at the lower surface of the lower wall 2 of the upper housing 1. See FIG. 2. Finally, by pushing the waste container 40 to place in the lower housing 1, as shown in FIG. 1, the claw portion 45 formed at the upper end portion of the rear wall 42 of the waste container 40 presses the operation end 37 of the operation lever 35, whereby the lock member 32 is pressed downward by means of an operation another end 36 of the operation lever 35. Through the above operation, the upper end portion of the lock member 32 is released from the engagement with the concave engagement 5 of the upper housing 1. At the same time, the side contact portion 44 of the side walls 43 of waste container 40 is abutted against and push the front-end flange 16 of the shutter 15. In this condition the exhaust port 3 of the upper housing 1, which was closed with the shutter 15, is made opened thereby enabling to discharge wastes chopped by the chopped apparatus.

In the shredder of the present invention, the guide cover 25 is formed of a pair of the cover member 26, 26, which includes the front-half portion 27 having a broader width and the rear-half portion 28 having a slightly broader width than the width of the claw portion 45. Accordingly in case the claw portion 45 of the waste container 40 is slightly deviated from its right position, from side to side, the claw portion 45 can still be appropriately guided along the front-half portion 27 with the broader width, whereby the claw portion 45 can certainly push the operation end 37 of the operation lever 35 located at the rear-half portion 28 of the guide cover 25.

Further, in the shredder of the present invention, the width of the rear-half portion 28 of the guide cover 25 is made slightly broader than the width of the claw portion 45. Accordingly, even if operators try to manually open the shutter 15 by pressing the operation end 37 of the operation lever 35 provided between the guide members 26, 26, the operators cannot press the operation end 37 unless using specially-designed tools having an approximately identical width with the claw portion 45. As described, for example, in case the operators pull out the waste container 40 from the lower housing 6 and try to take chopped wastes away from the exhaust port 3, the operators are inhibited from operating the operation end 37 of the operation lever 35, thus not being able to open the shutter 15. In addition, because, with the above reason, the operators cannot open the shutter 15, they cannot place their fingers inside of the exhaust port 3 of the upper housing 1, improving an operation safety of the shredder.

What is claimed is:

1. A shredder comprising:

a chopped apparatus including an insertion opening for inserting wastes, and an exhaust port for discharging chopped wastes;

a waste container which is displaceable between a receivable position where to receive the chopped wastes and a non-receivable position where not to receive the chopped wastes;

a claw portion provided with the waste container;

a shutter, which opens the exhaust port by moving the waste container to the receivable position, and which closes the exhaust port by moving the waste container to the non-receivable position wherein the shutter is energized in a direction to close the exhaust port;

a lock member, which is displaceable between a locked position where to close the exhaust port and an unlocked position where to open the exhaust port wherein the lock member is energized in a direction to the locked position; and an operation lever which displaces the lock member to the unlocked position;

wherein the operation lever is operated with the claw portion by moving the waste container to the receivable position thereby shifting the lock member from the locked position to the unlocked portion.

2. The shredder according to claim 1, wherein the operation lever is covered with a guide cover preventing operation thereof unless using a tool approximately identical with a width of the claw portion.

3. The shredder according to claim 2, wherein the guide cover is composed of a pair of cover members formed as to face with and go along the claw portion.

4. The shredder according to claim 3, wherein the pair of the cover members have a front-half portion and a rear-half portion wherein the front-half portion is widen toward the claw portion and has a broader width than the rear-half portion while the rear-half portion has a slightly broader width than the width of the claw portion.

5. The shredder according to any one of claims 2 to 4, wherein the lock member, the operation lever and the guide cover are provided with the shutter.

6. The shredder according to claim 4, wherein downward height of the rear-half portion of the pair of the cover members is set greater than downward height of an operation end of the operation lever, both in the receivable position and the non-receivable position.

* * * * *